US010627138B2

(12) United States Patent
Mizutani

(10) Patent No.: US 10,627,138 B2
(45) Date of Patent: Apr. 21, 2020

(54) AIR-CONDITIONING APPARATUS WITH RETURN OIL FLOW CONTROLLED THROUGH SOLENOID VALVES

(71) Applicant: Mitsubishi Electric Corporation, Tokyo (JP)

(72) Inventor: Shuhei Mizutani, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 66 days.

(21) Appl. No.: 15/761,483

(22) PCT Filed: Nov. 17, 2015

(86) PCT No.: PCT/JP2015/082241
§ 371 (c)(1),
(2) Date: Mar. 20, 2018

(87) PCT Pub. No.: WO2017/085784
PCT Pub. Date: May 26, 2017

(65) Prior Publication Data

US 2018/0266737 A1 Sep. 20, 2018

(51) Int. Cl.
*F25B 31/00* (2006.01)
*F25B 1/00* (2006.01)
*F25B 13/00* (2006.01)

(52) U.S. Cl.
CPC ..... *F25B 31/004* (2013.01); *F25B 1/00* (2013.01); *F25B 13/00* (2013.01); *F25B 31/002* (2013.01);
(Continued)

(58) Field of Classification Search
CPC .. F25B 31/002; F25B 31/004; F25B 2500/16; F25B 2700/03
See application file for complete search history.

(56) References Cited

U.S. PATENT DOCUMENTS 5,029,455 A * 7/1991 Backus ..... F25B 31/004 62/470
6,233,967 B1 * 5/2001 Seewald ..... F04C 29/0007 62/470
2017/0074527 A1 * 3/2017 Qian ..... F28F 27/003 62/470

FOREIGN PATENT DOCUMENTS

JP 2006-242392 A 9/2006
JP 2010-071614 A 4/2010
(Continued)

OTHER PUBLICATIONS

International Search Report of the International Searching Authority dated Feb. 9, 2016 for the corresponding international application No. PCT/JP2015/082241 (and English translation).
(Continued)

*Primary Examiner* — Henry T Crenshaw
*Assistant Examiner* — Daniel C Comings
(74) *Attorney, Agent, or Firm* — Posz Law Group, PLC

(57) ABSTRACT

An air-conditioning apparatus includes firstly a refrigerant circuit in which a condenser, an expander, an evaporator, a compressor, and an oil separator are connected by pipes, and secondly an oil return circuit configured to return oil from the oil separator to the compressor. The compressor includes an oil concentration sensor configured to detect oil concentration inside the compressor. The oil return circuit includes multiple solenoid valves that are each opened or closed corresponding to the oil concentration detected by the oil concentration sensor.

4 Claims, 3 Drawing Sheets

(52) U.S. Cl.
CPC ..... *F25B 2500/16* (2013.01); *F25B 2700/03* (2013.01)

(56) References Cited

FOREIGN PATENT DOCUMENTS

| | | | |
|---|---|---|---|
| JP | 2015-038406 | A | 2/2015 |
| JP | 2015-038407 | A | 2/2015 |
| JP | 2015-163823 | A | 9/2015 |

OTHER PUBLICATIONS

Office action dated Jan. 22, 2019 issued in corresponding JP patent application No. 2017-551421 (and English translation thereof).
Office Action dated Jul. 30, 2019 issued in corresponding JP patent application No. 2017-551421 (and English translation).

* cited by examiner

AIR-CONDITIONING APPARATUS WITH RETURN OIL FLOW CONTROLLED THROUGH SOLENOID VALVES

CROSS REFERENCE TO RELATED APPLICATION

This application is a U.S. national stage application of International Application No. PCT/JP2015/082241, filed on Nov. 17, 2015, the contents of which are incorporated herein by reference.

TECHNICAL FIELD

The present invention relates to an air-conditioning apparatus and an operation controller of the air-conditioning apparatus, and in particular, relates to an oil return circuit.

BACKGROUND

A refrigeration and air-conditioning apparatus formed of a compressor, an outdoor heat exchanger, an indoor-side expansion device, and an indoor heat exchanger connected to each other via a refrigerant circuit has been conventionally used. In some cases, such a refrigeration and air-conditioning apparatus is provided with an oil separator to separate refrigerant and a refrigerating machine oil mixed into refrigerant and brought out of the compressor, and an oil return circuit to return oil to the compressor. The oil return circuit is a pipe for connecting the oil separator on a discharge side of the compressor to a suction side of the compressor. The refrigerating machine oil brought out of the compressor is returned to the suction side of the compressor by the oil return circuit to prevent the refrigerating machine oil from flowing into an indoor-unit side pipe, and thereby oil level lowering in the compressor is prevented. In the oil return circuit, a predetermined constant amount of oil is returned, and a flow rate cannot be transitionally adjusted in some cases.

In contrast, in Patent Literature 1, a technique providing a solenoid valve that opens and closes in response to an oil level of a refrigerating machine oil accumulated in a compressor is suggested. Moreover, in Patent Literature 2, a technique for opening and closing a solenoid valve in response to a refrigerant concentration in a compressor is suggested. In both literatures, when an oil level in the compressor is not more than a certain value, the oil can be emergently returned.

PATENT LITERATURE

Patent Literature 1: Japanese Unexamined Patent Application Publication No. 2015-38407

Patent Literature 2: Japanese Unexamined Patent Application Publication No. 2015-38406

In Patent Literature 1 or Patent Literature 2, when oil shortage occurs in the compressor due to lowering of the oil level in the compressor or increase of refrigerant concentration in the compressor, oil is emergently returned. Consequently, it is considered that extreme shortage of oil in the compressor can be avoided.

However, in general, to prevent shortage of oil in the compressor, the refrigerant circuit is designed to include oil in an amount larger than a necessary oil amount. Consequently, when oil is excessively returned to the compressor due to the operating situation of the air-conditioning apparatus, the method in Patent Literature 1 or Patent Literature 2 cannot avoid excessive refrigerating machine oil. When oil is excessively returned to the compressor, the oil is compressed together with refrigerant, and thereby efficiency in the compressor is deteriorated.

SUMMARY

The present invention has been made to solve the above problem, and has an object to obtain an air-conditioning apparatus and an operation controller of the air-conditioning apparatus capable of maintaining oil in a compressor at an appropriate amount and preventing efficiency degradation due to oil compression in the compressor.

An air-conditioning apparatus of one embodiment of the present invention includes a refrigerant circuit in which a condenser, an expander, an evaporator, a compressor, and an oil separator are connected by pipes, and an oil return circuit configured to return oil from the oil separator to the compressor, in which the compressor includes an oil concentration sensor configured to detect oil concentration inside the compressor, and the oil return circuit includes multiple solenoid valves that are each opened or closed corresponding to the oil concentration detected by the oil concentration sensor.

In an air-conditioning apparatus and an operation controller of the air-conditioning apparatus of one embodiment of the present invention, multiple solenoid valves provided to an oil return circuit are controlled to open or close in response to oil concentration in a compressor. This configuration can maintain an oil amount in the compressor at an appropriate amount and prevent efficiency degradation due to oil compression in the compressor.

DETAILED DESCRIPTION

Embodiment

Figure 1:
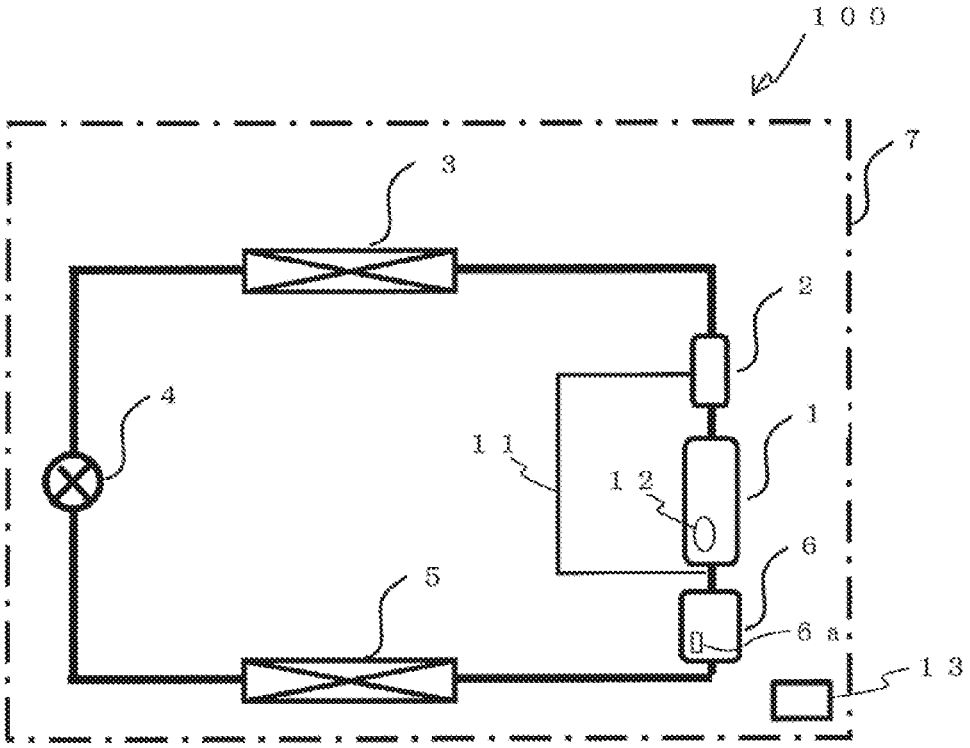
FIG. 1 is a block diagram of an air-conditioning apparatus according to an embodiment.

FIG. 1 is a block diagram of an air-conditioning apparatus 100 according to the embodiment. As shown in FIG. 1, the air-conditioning apparatus 100 includes a compressor 1, an oil separator 2, a condenser 3, an expander 4, an evaporator 5, and an accumulator 6, and the components are successively connected by pipes to constitute a refrigerant circuit 7. The components of the refrigerant circuit 7 are contained in an outdoor unit and an indoor unit. Then, when the air-conditioning apparatus 100 is in the cooling operation, a heat exchanger disposed in the outdoor unit acts as the condenser 3, whereas, when the air-conditioning apparatus 100 is in the heating operation, the heat exchanger disposed in the outdoor unit acts as the evaporator 5.

The compressor 1 sucks and compresses low-temperature and low-pressure gas refrigerant to change into high-temperature and high-pressure refrigerant to be discharged. The compressor 1 includes an oil concentration sensor 12 detecting the oil concentration of the refrigerating machine oil contained in refrigerant inside the compressor 1 and notifying the controller 13 of the oil concentration. The controller 13 is an example of an operation controller according to the present invention. The oil concentration sensor 12 is electrically connected to the controller 13. The oil separator 2 is connected to the discharge side of the compressor 1 and separates the refrigerating machine oil from refrigerant discharged from the compressor 1. The refrigerating machine oil is a lubricating oil of the compressor 1. The refrigerating machine oil separated in the oil separator 2 is returned to the suction side of the compressor 1 by an oil return circuit 11. The condenser 3 allows the refrigerant separated by the oil separator 2 to flow in, and condenses the refrigerant to be subjected to heat exchange with outside air. The expander 4 expands the refrigerant flowing in to generate and discharge low-temperature gas refrigerant. The evaporator 5 allows the low-temperature and low-pressure gas refrigerant generated by the expander 4 to flow in, and evaporates the refrigerant to be subjected to heat exchange with the outside air. The accumulator 6 accumulates, of the refrigerant, surplus refrigerant, and connected to the suction side of compressor 1. In the accumulator 6, a liquid level sensor 6*a* detecting a liquid level may be disposed.

Figure 2:
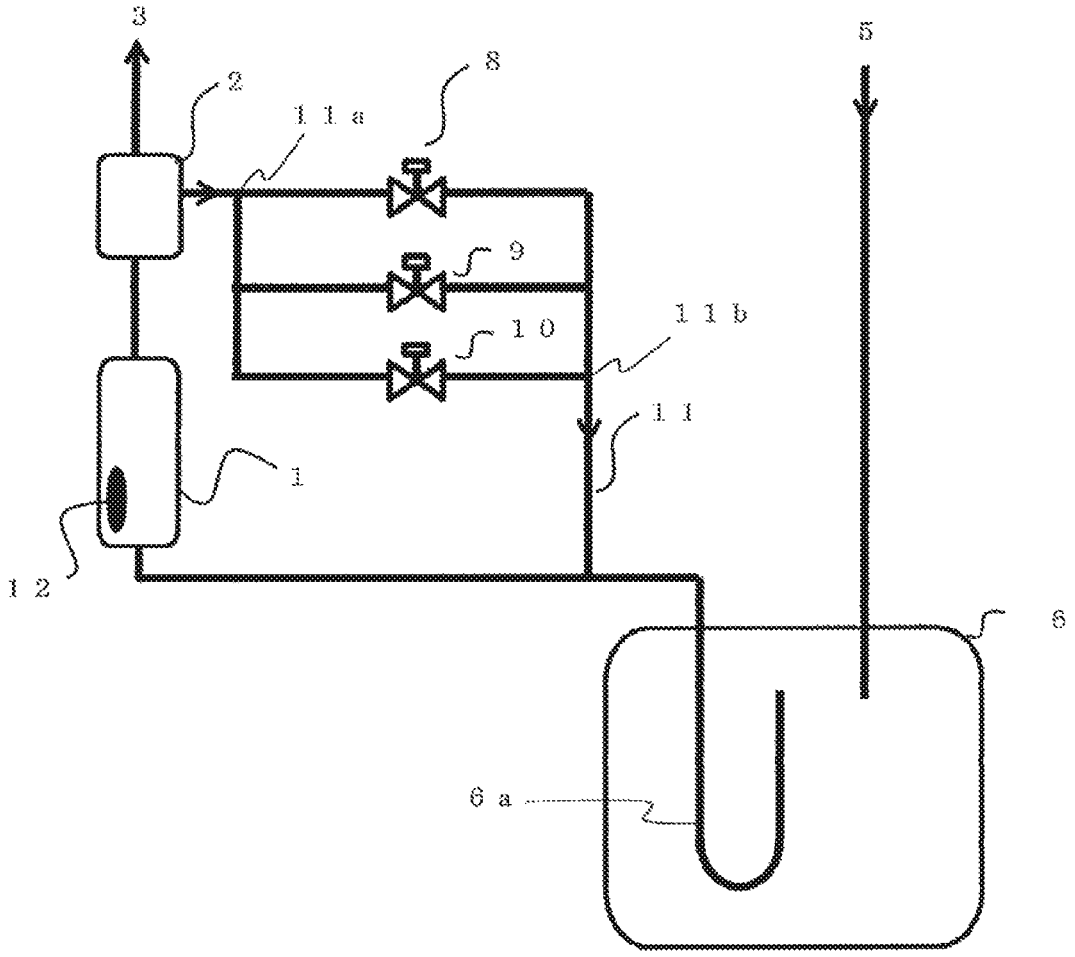
FIG. 2 is a block diagram of an oil return circuit of the air-conditioning apparatus in FIG. 1.

FIG. 2 is a block diagram of the oil return circuit 11 of the air-conditioning apparatus 100 in FIG. 1. As shown in FIG. 2, the oil return circuit 11 is formed of multiple solenoid valves including a main solenoid valve 8, a first sub solenoid valve 9, and a second sub solenoid valve 10 connected in parallel. The oil return circuit 11 is a pipe returning the refrigerating machine oil separated in the oil separator 2 to the suction side of the compressor 1. The pipe constituting the oil return circuit 11 branches at a branch point 11*a* to connect the main solenoid valve 8, the first sub solenoid valve 9, and the second sub solenoid valve 10 in parallel and gathers again at a gathering point 11*b*. Each of the main solenoid valve 8, the first sub solenoid valve 9, and the second sub solenoid valve 10 is electrically connected to the controller 13, and opening and closing of each of the solenoid valves is controlled on the basis of the oil concentration in the compressor 1 detected by the oil concentration sensor 12 and stored in the controller 13. In each of the main solenoid valve 8, the first sub solenoid valve 9, and the second sub solenoid valve 10, a different threshold concentration Th is set, and each solenoid valve is controlled to be closed when the oil concentration is larger than the threshold concentration Th. Note that the main solenoid valve 8, the first sub solenoid valve 9, and the second sub solenoid valve 10 may have different diameters of small, medium and large, or, may have the same diameters. Moreover, in addition to the main solenoid valve 8, the first sub solenoid valve 9, and the second sub solenoid valve 10, a capillary tube can be connected to adjust the flow rate. Note that at least two solenoid valves may be connected.

Figure 3:
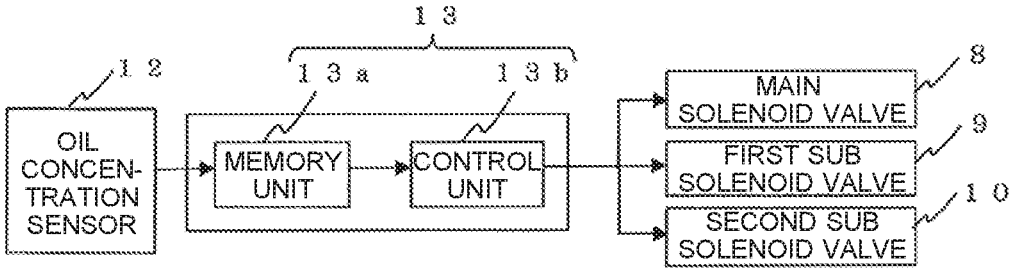
FIG. 3 is a block diagram of a controller controlling solenoid valves.

FIG. 3 is a block diagram of the controller 13 controlling the solenoid valves. Note that, in the following description, the main solenoid valve 8, the first sub solenoid valve 9, and the second sub solenoid valve 10 will be collectively referred to as solenoid valves. As shown in FIG. 3, the controller 13 includes a memory unit 13*a* and a control unit 13*b* to control each of the solenoid valves on the basis of the oil concentration X in the compressor 1 detected by the oil concentration sensor 12. The memory unit 13*a* stores the threshold concentration Th set in each of the solenoid valves in advance and the oil concentration X in the compressor 1 detected by the oil concentration sensor 12. The control unit 13*b* compares each threshold concentration Th with the oil concentration X stored in the memory unit 13*a*, and, when the oil concentration X is larger than the threshold concentration Th, controls the solenoid valve to be closed, and, when the oil concentration X is not larger than the threshold concentration Th, controls the solenoid valve to be opened.

Figure 4:
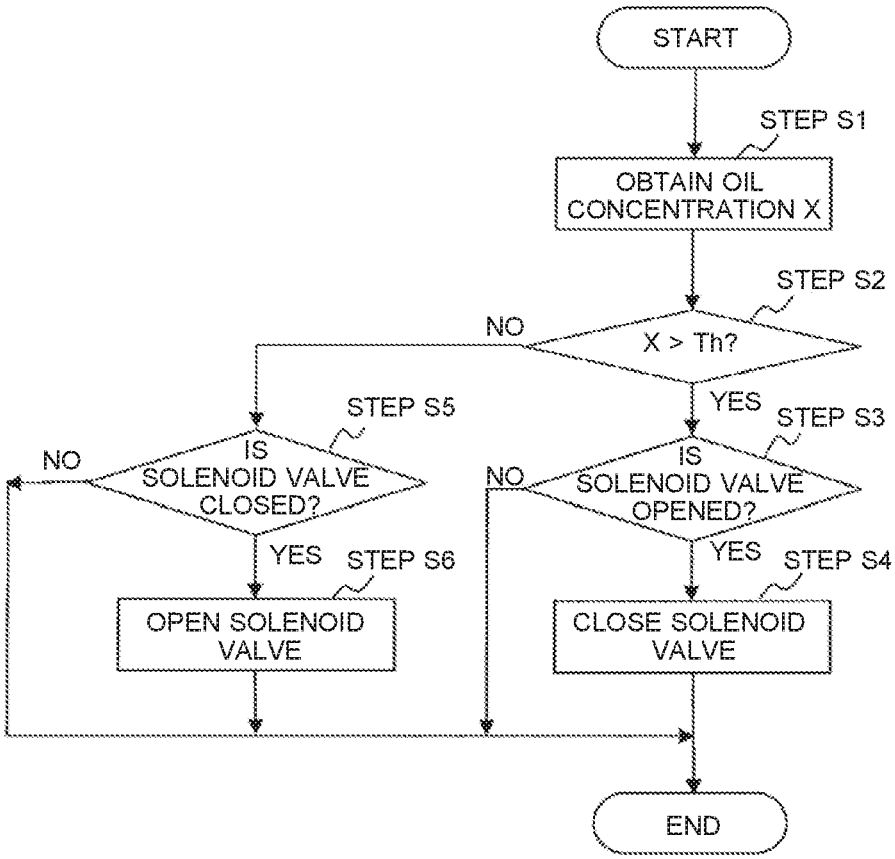
FIG. 4 is a flowchart illustrating control of the solenoid valves by the controller.

FIG. 4 is a flowchart illustrating control of the solenoid valves by the controller 13. The controller 13 controls each of the solenoid valves as shown in FIG. 4 in parallel on the basis of the oil concentration X and the threshold concentration Th set in each of the solenoid valves.

As shown in FIG. 4, when activation of the compressor 1 is started and the control by the controller 13 is started, in step S1, the controller 13 obtains the oil concentration X in the compressor 1 detected by the oil concentration sensor 12. Then, in step S2, the controller 13 compares the oil concentration X and the threshold concentration Th set in each of the solenoid valves. When the oil concentration X is larger than the threshold concentration Th, in step S3, the controller 13 determines whether or not the solenoid valve is opened, and when the solenoid valve is determined to be opened, the process proceeds to step S4, and the controller 13 closes the solenoid valve in step S4.

On the other hand, when the oil concentration X is not larger than the threshold concentration Th in step S2, the process proceeds to step S5. In step S5, the controller 13 determines whether or not the solenoid valve is closed, and when the solenoid valve is determined to be closed, the process proceeds to step S6, and the controller 13 opens the solenoid valve in step S6.

In this manner, the controller 13 compares the oil concentration X with the threshold concentration Th, and, when the oil concentration X is not larger than the threshold concentration Th, opens the solenoid valve, whereas, when the oil concentration X is larger than the threshold concentration Th, closes the solenoid valve. Then, when the process is finished, after a predetermined interval, a new oil concentration X is obtained to perform the process on the basis of the oil concentration X. The process is repeated regularly until the operation of the compressor 1 is stopped. Consequently, oil is always returned to the compressor 1 at an appropriate flow rate.

Subsequently, action of refrigerant and oil in the air-conditioning apparatus 100 will be described.

The refrigerant flowing through the refrigerant pipe is compressed in the compressor 1, changed into the high-temperature and high-pressure gas refrigerant to flow out of the compressor 1, and flows into the oil separator 2 connected to a secondary side of the compressor 1. The oil is separated from the refrigerant in the oil separator 2, and the refrigerant flows into the condenser 3, passes through the expander 4 and evaporator 5 to reach the accumulator 6 to be temporarily accumulated, and flows into the compressor 1 again.

On the other hand, the refrigerating machine oil in the compressor 1 is compressed together with the refrigerant in the compressor 1 to be mixed into the refrigerant to flow out, and is separated from the refrigerant in the oil separator 2. The oil separated in the oil separator 2 flows into the oil return circuit 11 and reaches the branch point 11*a* of the oil return circuit 11. Then, from the branch point 11*a*, the oil passes through a solenoid valve that is open among the main solenoid valve 8, the first sub solenoid valve 9, and the second sub solenoid valve 10, and then gathers again at the gathering point 11*b* to reach an end of the oil return circuit 11. The oil is merged with the refrigerant flowing through the refrigerant circuit 7 on a primary side of the compressor 1 from the end of the oil return circuit 11, and flows into the compressor 1 together with the refrigerant again. Consequently, oil return operation is completed.

In the oil return circuit 11, each of the connected solenoid valves is operated by the control of the controller 13 shown in FIG. 2. For example, a case is considered in which, as the threshold concentration Th, a main threshold value Thmain, a first sub threshold value Ths1, and a second sub threshold value Ths2 are set in the main solenoid valve 8, the first sub solenoid valve 9, and the second sub solenoid valve 10, respectively. A case is assumed where the threshold values are in a relationship of main threshold value Thmain>first sub threshold value Ths1>second sub threshold value Ths2. In this case, when the oil concentration X is larger than the main threshold value Thmain, which is an upper limit value, all of the solenoid valves are closed, and thereby the oil is not returned. Moreover, when the oil concentration X has a value equal to or smaller than the main threshold value Thmain and larger than the first sub threshold value Ths1, only the main solenoid valve 8 is opened, and the first sub solenoid valve 9 and the second sub solenoid valve 10 are closed. When the oil concentration X has a value equal to or smaller than the first sub threshold value Ths1 and larger than the second sub threshold value Ths2, the main solenoid valve 8 and the first sub solenoid valve 9 are opened, and the second sub solenoid valve 10 is closed. Then, when the oil concentration X has a value not larger than the second sub threshold value Ths2, which is a lower limit value, all of the solenoid valves are opened, and thereby the oil is returned at the maximum flow rate.

As described above, when the oil concentration X in the compressor 1 is larger than the upper limit value, no oil needs to be returned to the compressor 1, all of the solenoid valves are closed, and the oil return operation is stopped by the solenoid valves. Moreover, when the oil concentration X is not larger than the lower limit value, all of the solenoid valves are opened to return oil at the maximum flow rate. Consequently, surplus oil is not mixed into the refrigerant pipe. This configuration can prevent efficiency degradation in the compressor 1 due to increase of the oil concentration X while an oil amount in the compressor 1 is maintained at an appropriate amount.

In the air-conditioning apparatus 100 according to the embodiment, the oil concentration X in the compressor 1 is detected by the oil concentration sensor 12 contained in the compressor 1, and the multiple solenoid valves provided in the oil return circuit 11 are opened or closed in response to the detected oil concentration X. Consequently, when the oil concentration X is low, the solenoid valve is opened, and when the oil concentration X is high, the solenoid valve is closed, and thereby the flow rate in the oil return circuit is adjusted. The oil concentration X in the compressor 1 is appropriately maintained, and thereby efficiency degradation in the compressor 1 due to increase of the oil concentration X can be prevented.

As each solenoid valve is opened or closed with a different oil concentration as the threshold value, the solenoid valve to be opened or closed is determined corresponding to the value of the oil concentration X detected by the oil concentration sensor 12. This configuration can adjust the upper limit and the lower limit of the flow rate in the oil return circuit 11.

The multiple solenoid valves can be connected in parallel in the oil return circuit 11.

In particular, by providing the solenoid valves having different diameters, it is possible to more finely adjust the flow rate in the oil return circuit 11.

The solenoid valves are opened or closed by the controller 13 corresponding to the oil concentration X detected by the oil concentration sensor 12.

The invention claimed is:

1. An air-conditioning apparatus comprising:

a refrigerant circuit in which a condenser, an expander, an evaporator, a compressor, and an oil separator are connected by pipes;

an oil return circuit configured to return oil from the oil separator to the compressor; and a controller, the compressor including an oil concentration sensor configured to detect oil concentration inside the compressor, the oil return circuit including:

a single first pipe, a plurality of second pipes, and a single third pipe, the single first pipe branching, at a branch point included in a middle part of the single first pipe, into a plurality of the second pipes, connected in parallel, the plurality of second pipes gathering into the single third pipe at a gathering point, and the single third pipe extending from the gathering point, and a plurality of solenoid valves that are each opened or closed corresponding to the oil concentration detected by the oil concentration sensor, the plurality of solenoid valves being each connected to a corresponding one of the plurality of second pipes, and the controller being configured to, regularly, perform an opening and closing control of the plurality of solenoid valves based on the oil concentration.

2. The air-conditioning apparatus of claim 1, wherein the plurality of solenoid valves have different threshold values, and each of the plurality of solenoid valves is closed when the oil concentration is larger than a corresponding one of the threshold values.

3. The air-conditioning apparatus of claim 1, wherein the plurality of solenoid valves have different diameters.

4. An operation controller for an air-conditioning apparatus including a refrigerant circuit in which a condenser, an expander, an evaporator, a compressor, and an oil separator are connected by pipes, comprising:

a detection unit configured to detect oil concentration inside the compressor by an oil concentration sensor;

a memory unit configured to store a threshold concentration for opening or closing a plurality of solenoid valves included in an oil return circuit configured to return oil from the oil separator to the compressor, the threshold concentration being set in each of the plurality of solenoid valves; and a control unit configured to compare the oil concentration detected in the detection unit with each of the plurality of the threshold concentrations, and, when the oil concentration is higher than one of the plurality of the threshold concentrations, close the solenoid valve in which the one of the plurality of the threshold concentrations is set, the oil return circuit including a single first pipe, a plurality of second pipes, and a single third, the single first pipe branching, at a branch point included in a middle part of the single first pipe, into a plurality of the second pipes, connected in parallel, the plurality of second pipes gathering into the single third pipe at a gathering point, and the single third pipe extending from the gathering point, the plurality of solenoid valves being each connected to a corresponding one of the plurality of second pipes, and the control unit further configured to, regularly, perform an opening and closing control of the plurality of solenoid valves based on the oil concentration.

* * * * *